US007022031B2

(12) United States Patent
Nishio

(10) Patent No.: US 7,022,031 B2
(45) Date of Patent: Apr. 4, 2006

(54) IRON-TYPE GOLF CLUB HEAD

(75) Inventor: Masayoshi Nishio, Kobe (JP)

(73) Assignee: SRI Sports Limited, Kobe (JP)

( * ) Notice: Subject to any disclaimer, the term of this patent is extended or adjusted under 35 U.S.C. 154(b) by 0 days.

(21) Appl. No.: 10/293,597

(22) Filed: Nov. 14, 2002

(65) Prior Publication Data

US 2003/0092504 A1 May 15, 2003

(30) Foreign Application Priority Data

Nov. 14, 2001 (JP) ..... 2001-349190

(51) Int. Cl.
*A63B 53/04* (2006.01)

(52) U.S. Cl. ..... 473/342; 473/349; 473/350

(58) Field of Classification Search ..... 473/324, 473/342, 349, 350, 290, 291
See application file for complete search history.

(56) References Cited

U.S. PATENT DOCUMENTS 4,345,763 A * 8/1982 Swanson ..... 473/242
5,176,384 A * 1/1993 Sata et al. ..... 473/329
5,308,062 A * 5/1994 Hogan ..... 473/292
5,377,985 A * 1/1995 Ohnishi ..... 473/324
5,429,353 A * 7/1995 Hoeflich ..... 473/350
5,722,900 A * 3/1998 Sung ..... 473/291
5,743,813 A * 4/1998 Chen et al. ..... 473/329
5,823,887 A * 10/1998 Mikame et al. ..... 473/290
5,899,820 A * 5/1999 Minematsu et al. ..... 473/329
6,220,971 B1 * 4/2001 Takeda ..... 473/342
6,435,981 B1 * 8/2002 Naruo et al. ..... 473/329
6,517,448 B1 * 2/2003 Takeda ..... 473/324

FOREIGN PATENT DOCUMENTS

JP 8168541 7/1996
JP 9192273 7/1997

* cited by examiner

*Primary Examiner*—Sebastiano Passaniti
(74) *Attorney, Agent, or Firm*—Birch Stewart Kolasch & Birch LLP

(57) ABSTRACT

An iron-type golf club head comprises a face portion whose surface defines a club face for hitting a ball, the face portion is provided with a thin part which is defined as having a thickness of not more than 3 mm, the thin part defines at least a part of the club face including a sweet spot, and the distance across the thin part measured in every direction is not less than 30 mm.

12 Claims, 4 Drawing Sheets

IRON-TYPE GOLF CLUB HEAD

This nonprovisional application claims priority under 35 U.S.C. § 119(a) on Patent Application No. 2001-349190 filed in Japan on Nov. 14, 2001, which is herein incorporated by reference.

BACKGROUND OF THE INVENTION

The present invention relates to an iron-type golf club head, more particularly to a structure for the face portion being capable of improving rebound performance.

In recent years, in order to increase carry, there have been made many attempts at improving the rebound performance by increasing elastic deformation of the face portion when hitting a ball.

For example, the laid-open Japanese patent application JP-A-9-192273 discloses a wood-type golf club head, wherein the face portion is composed of a relatively thick central part and a relatively thin peripheral part in order to improve elasticity deformation when hitting a ball.

However, based on the inventor's study on rebound performance of the iron-type golf club heads, it was found to be important that the face portion is provided with a thin part having a specified thickness including the sweet spot for increasing flexure of the face portion when hitting a ball, and the distance across the thin part measured in every direction passing through the sweet spot is more than a specific value to optimize the flexure around the sweet spot.

SUMMARY OF THE INVENTION

It is therefore, an object of the present invention to provide an iron-type golf club head of which rebound performance is improved to increase carry by optimizing the flexure of the face portion around the sweet spot.

According to the present invention, an iron-type golf club head comprises a face portion whose surface defines a club face for hitting a ball, the face portion provided with a thin part which is defined as having a thickness of not more than 3 mm, the thin part defining at least a part of the club face including a sweet spot, and the distance across the thin part measured in every direction passing through the sweet spot becomes a minimum L1 in a certain direction, and the minimum L1 is not less than 30 mm.

DESCRIPTION OF THE PREFERRED EMBODIMENT(S)

Figure 1A:
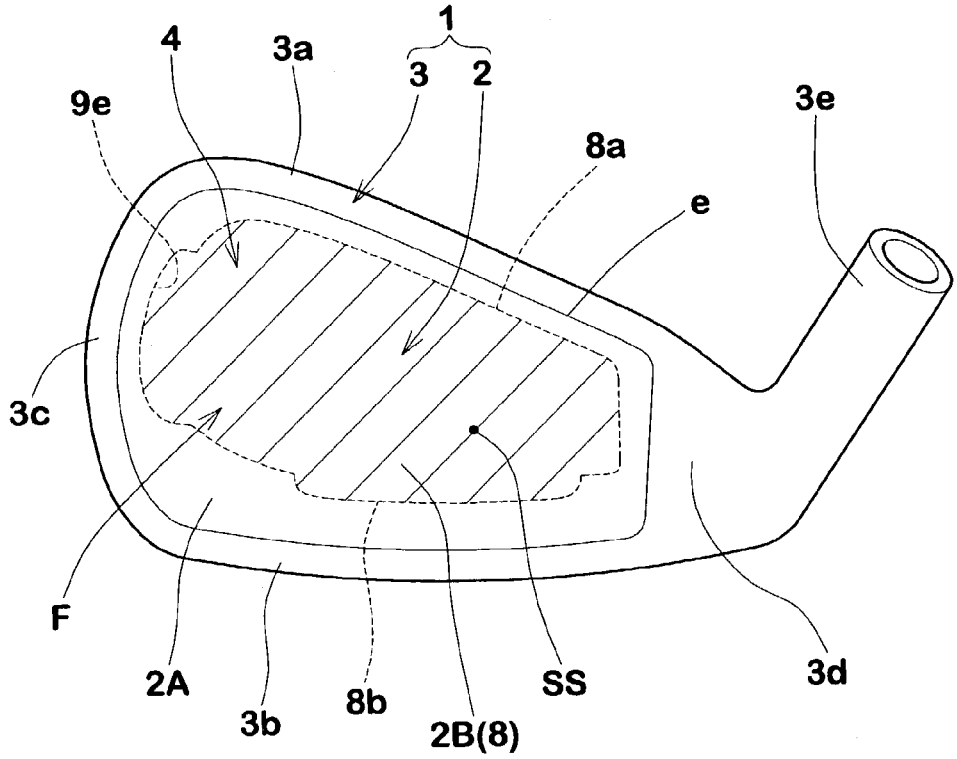
FIG. 1A is a front view of an iron-type golf club head according to the present invention wherein the club face is set vertically so that the loft angle becomes zero degree although the actual loft angle specified therefor is not zero degree.

Embodiments of the present invention will now be described in detail in conjunction with the accompanying drawings.

In the drawings, iron-type golf club head 1 according to the present invention comprises a face portion 4 whose front surface defines a club face F for hitting a ball, the face portion 4 is provided with a thin part 8 which is defined as having a thickness of not more than 3 mm, the thin part 8 defines at least a part of the club face F which part includes a sweet spot SS and has dimensions such that the distance across the thin part passing through the sweet spot SS becomes a minimum L1 of not less than 30 mm, preferably more than 33 mm, more preferably more than 35 mm in a certain direction. In other words, as shown in FIG. 1B, when the distance across the thin part is measured in every direction (K) passing through the sweet spot SS, the minimum distance L1 occurs in a certain direction (in FIG. 2, for example, direction K1) intersecting the upper edge 8*a* and lower edge 8*b* of the thin part. On the straight line drawn along the minimum distance (namely, A—A line), the sweet spot SS is positioned on the middle segment of equally divided three segments of the straight line. If the minimum distance L1 is excessively large, the durability of the face portion is liable to decrease and the center G of gravity becomes higher which will result in higher trajectory due to backspin. Therefore, the minimum distance L1 is preferably set in a range of not more than 45 mm, more preferably not more than 40 mm, still more preferably not more than 38 mm.

Here, the sweet spot SS is defined as a point on the club face F at which a normal line N to the club face F drawn from the center G of gravity of the club head intersects the club face F. Further, the undermentioned sweet spot height is defined as a distance of the sweet spot SS measured in the vertical direction from a horizontal plane under such a condition that the club head is set on the above-mentioned horizontal plane satisfying its lie angle and loft angle.

Figure 2:
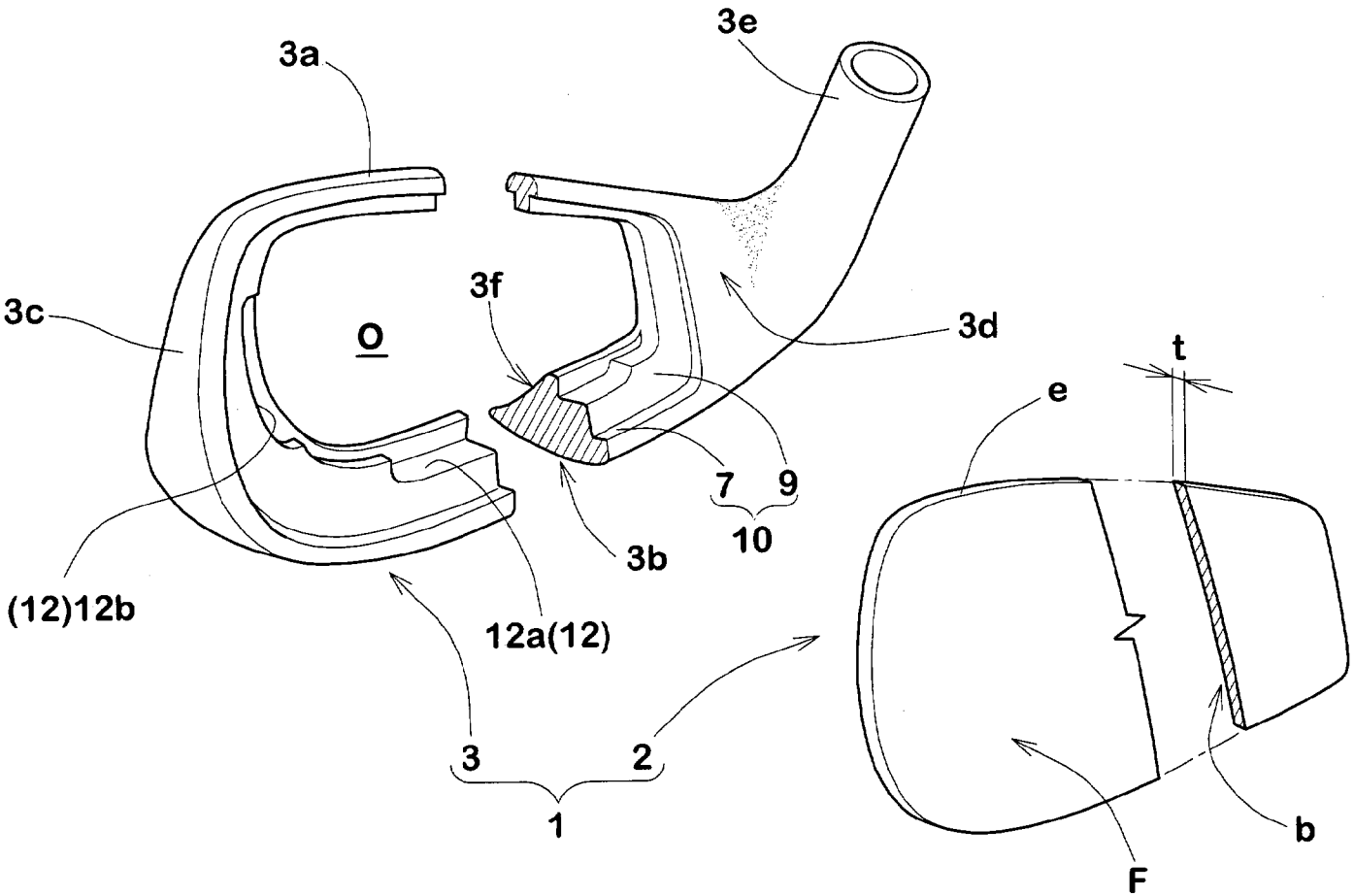
FIG. 2 is an exploded perspective view of the golf club head showing a two-piece structure.

FIG. 2 shows an example of the structure for the club head 1 which comprises a head main body 3 and a face plate 2.

The face plate 2 has a front surface, a back surface (b) and a circumferential side surface (e). The front surface defines at least a part of the club face F. In this example, the front surface defines the entirety of the club face F. The face plate 2 in this example has a substantially constant thickness (t) of not more than 3.0 mm, preferably 2.0 to 3.0 mm, more preferably 2.3 to 2.8 mm. If the thickness (t) of the face plate 2 exceeds 3.0 mm, there is a tendency for the rebound performance to decrease. If the thickness (t) is less than 2.0 mm, the face portion 4 tends to decrease its durability. As the face plate 2 is relatively thin, the tensile strength of the face plate 2 is preferably set in a range of from 300 to 2000 MPa, more preferably 500 to 1500 MPa, still more preferably 800 to 1500 MPa for the durability of the face plate 2. For the rebound performance, on the other hand, it is preferable that the Young's modulus of the face plate 2 is lower, therefore, the Young's modulus is set in a range of from 70 to 200 GPa, preferably 70 to 180 GPa, more preferably 100 to 180 GPa. In this example, to meet the above requirements, one of titanium alloys (Ti-6Al-4V) is selected as a metal material for the face plate 2.

The front surface of the face plate 2 defining the club face F is substantially flat excepting unevenness such as face grooves or lines which may be provided to increase friction against a ball.

The face plate 2 is attached on the front of the head main body 3 using a face plate mount 10 formed on the head main body 3.

Figure 4:
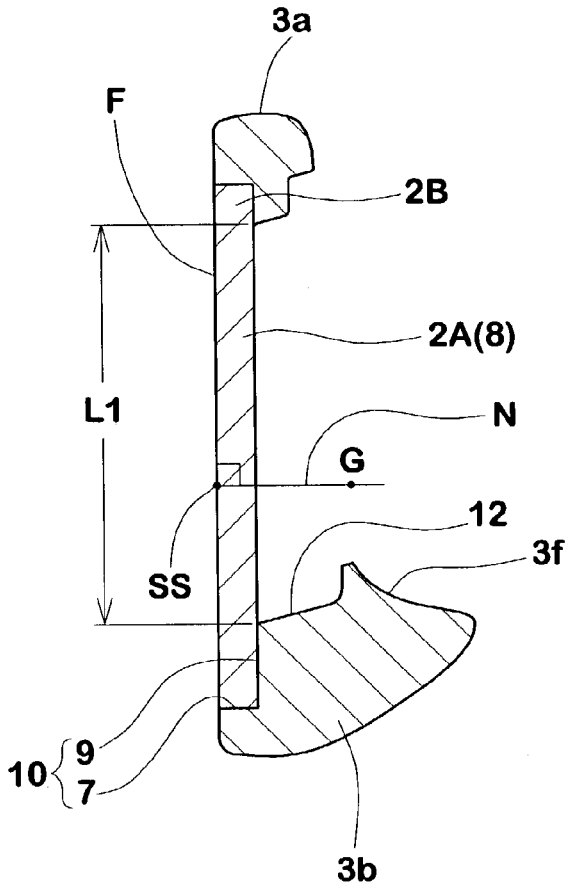
FIG. 4 is a cross sectional view of the club head taken along a line A—A in FIG. 1B.
Figure 5:
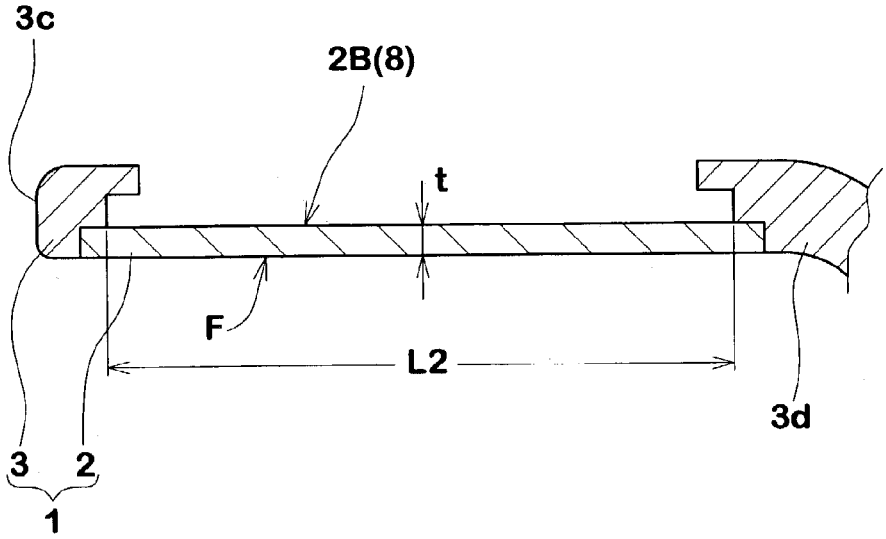
FIG. 5 is a cross sectional view of the club head taken along a line B—B in FIG. 1B.

The head main body 3 comprises a top portion 3*a*, a sole portion 3*b*, a toe portion 3*c*, a heel portion 3*d* and a hosel 3*e*. The top portion 3*a*, sole portion 3*b*, toe portion 3*c* and heel portion 3*d* are circularly arranged to form a through hole (O) surrounded thereby. Thus, the through hole (O) has an opening at the front of the head main body 3 and an opening at the rear of the head main body 3. The hosel 3*e* is formed integrally with the heel portion 3*d* and provided with a shaft inserting hole. In order to make the center G of the gravity deeper and lower, the sole portion 3*b* is, as shown in FIGS. 2 and 4, provided with a backward extension 3*f* forming the sole of the club head 1.

The head main body 3 is, in contrast to the face plate, made of a metal material whose specific gravity is relatively large. Foe example, stainless steel such as SUS630 is used.

Thus, the club head 1 has a two-piece structure of the titanium alloy face plate 2 and stainless steel main body 3. Such two-piece structure may be of help to widen the sweet spot area because the weight of the club head shifts towards the peripheral part of the face portion 4.

The face plate mount 10 is to give support to the peripheral part of the face plate 2 and it is formed at the front end of the through hole (O).

Figure 3:
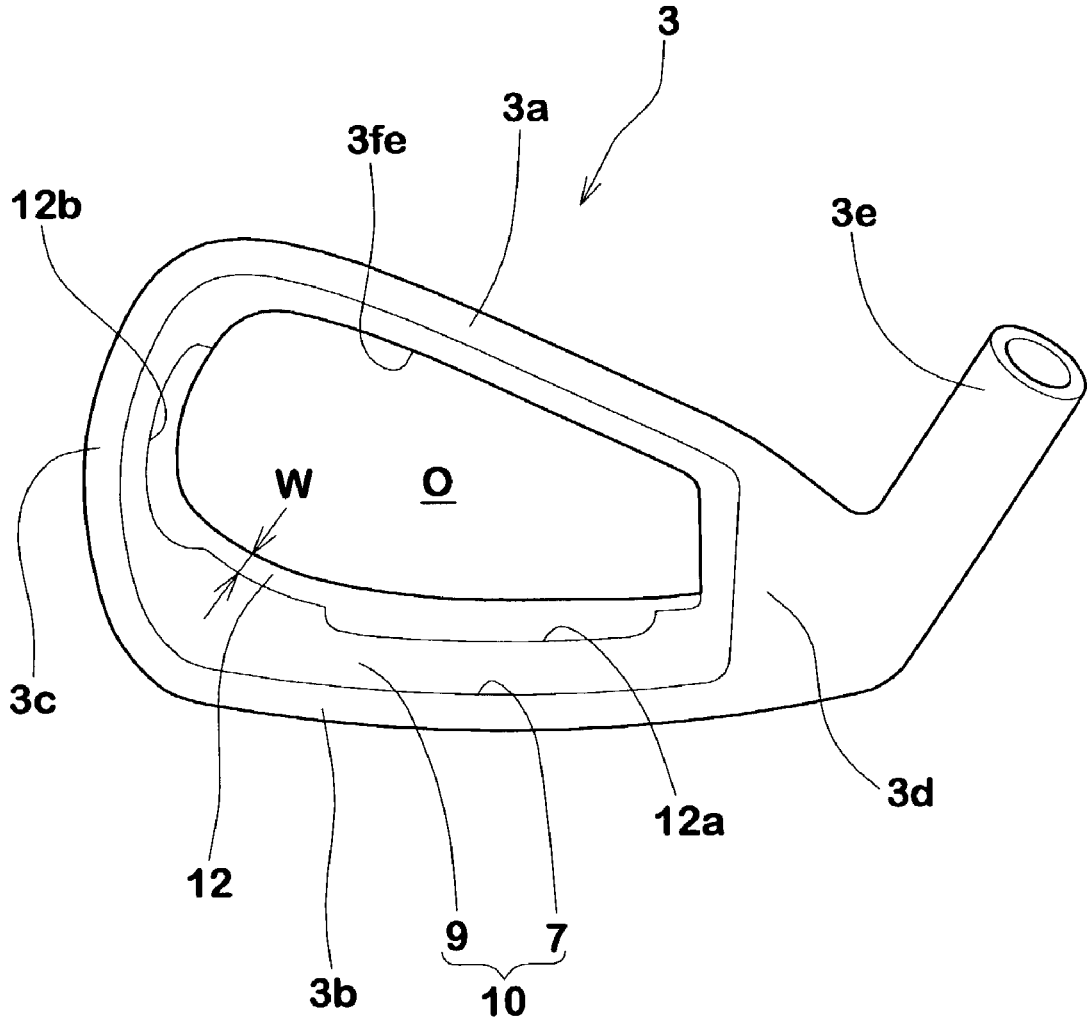
FIG. 3 is a front view of the head main body thereof in the same posture as in FIG. 1A.

The face plate mount 10 in this example is, as shown in FIGS. 2 and 3, defined by a side-support wall 7 and a back-support wall 9 which are formed continuously along the edge of the opening in a form like a stepped hole.

The side-support wall 7 gives side support to the face plate 2 by its inward surface which extends continuously through the portions 3*a*, 3*b*, 3*c* and 3*d* and comes into contact with the circumferential side surface (e) of the face plate 2.

The back-support wall 9 gives back support to the face plate 2 by its front surface which protrudes perpendicularly to the above-mentioned inward surface of the side-support wall 7 from the rear edge of the inward surface and extends continuously through the portions 3*a*, 3*b*, 3*c* and 3*d* so as to contact with the periphery part of the back surface (b).

The shape of the face plate 2 is accommodated to the shape of the face plate mount 10, and the face plate 2 is fitted in the face plate mount 10 and fixed to the main body 3 by means of caulking, adhesive bonding, soldering, press fitting, welding or the like.

Therefore, a part 2B which does not contact with the back-support wall 9 and is surrounded by the periphery part 2A contacting with the back-support wall 9 is formed. The above-mentioned thin part 8 is defined by this unsupported part 2B. (this part 2B or 8 is indicated in FIG. 1A as a hatched area) Incidentally, the periphery part 2A and back-support wall 9 form an annular thicker part of the face portion 2 surrounding the thin part 8.

Figure 1B:
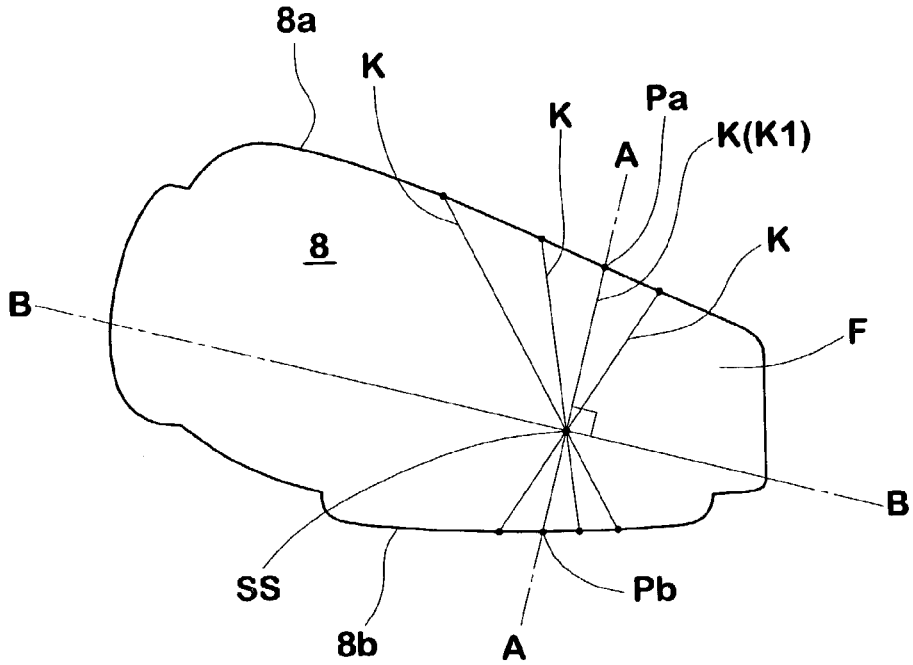
FIG. 1B is a diagram for showing the shape of the thin part of the face portion thereof and explaining the distance across the thin part passing the sweat spot.

As shown in FIG. 1A, the face portion 4 gradually increases its height from the heel portion to the toe portion. As a result, if the center G of gravity is shifted towards the toe portion, the minimum distance L1 may be easily increased. However, if shifted too much, the directional stability is liable to be lost because a return motion of the club head immediately after hitting a ball becomes insufficient. It is therefore, preferable that the position of the center G of gravity is limited relatively to the club shaft such that the distance of the center G of gravity from the center line of the club shaft or the center line of the shaft inserting hole of the hosel 3*e* is in a range of from 35 to 42 mm, more preferably 36 to 40 mm.

Further, the minimum distance L1 may be increased by increasing the area of the club face. In this case, however, the position of the center G of gravity also tends to become high and accordingly the position of the sweet spot SS becomes unfavorably high and the carry is liable to decrease. Therefore, it is preferable that the height of the sweet spot SS is set in a range of from 18 to 22 mm, more preferably 19 to 21 mm without greatly increasing the area of the club face.

In a direction (B—B) passing through the sweet spot SS at a right angle to the direction (A—A) of the minimum distance L1, the distance (L2) across the thin part 8 is preferably set in a range of not less than 65 mm. As a result, the flexure of the face portion can be more effectively improved to improve the rebound performance. Further, if the distance (L2) is too large, the durability of the face plate 2 tends to deteriorate. Therefore, it is preferable that the distance (L2) is set in a range of from 1.35 to 2.30 times, more preferably 1.44 to 2.17 times the minimum distance L1.

The area of the thin part 8 is set in a range of not less than about 1500 sq.mm but not more than about 3000 sq.mm, preferably not more than about 2500 sq.mm, more preferably not more than about 2000 sq.mm. If the thin part 8 is less than 1500 sq.mm, it becomes difficult to improve the rebound performance. If more than 3000 sq.mm, the durability tends to show rapid deterioration.

Although the minimum distance L1 can be increased by simply increasing the size of the club head, it involves the above explained problems. Therefore, in this embodiment, in order to obtain the minimum distance L1 of more than 30 mm, the wall height of the back-support wall 9 is decreased in the heel portion 3*d* beneath the sweet spot SS by providing a depressed part 12*a*. The depressed part 12*a* ranges over 50% of its length in the heel portion 3*d* but not the entire length. As a result, a relatively high wall part is formed on each side of the depressed part 12*a*. Also in order to obtain the above-mentioned distance (L2) of more than 65 mm, the wall height is decreased in the toe portion 3*c* by providing a depressed part 12*b*. Here, the wall height means a measurement in a direction perpendicular to the inward surface of the side-support wall 7.

In order to make the center G of the gravity deeper and lower and also to aesthetically improve the back view of the club head, in respect of the front-rear direction of the club head, the depressed part 12 (12*a*, 12*b*) does not reach to the back surface of the head main body 3 and terminates in the head main body 3 so that the opening at the rear end of the through hole (O) has an even shape as shown in FIGS. 2 and 3. This shape is generally similar to the outline of the face portion 2. In the sole portion 3*b* and its extension 3*f*, accordingly, as shown in FIG. 4, an upwardly extending wall or a step is formed due to the termination and as a result, the thickness of the sole portion measured in the direction parallel to the club face F reaches to a maximum and then gradually decreases towards the rear end.

Considering based on the opening at the rear end, the depressed part 12*a* in the sole portion 3*b* and the depressed part 12*b* in the toe portion 3*c* are connected through a depressed part 12*c* as shown in FIG. 3. In other words, varying the amount W of the dent from the inner edge 3*fe* of the opening, a single continuous depressed part 12 is formed from a position in the sole portion 3*b* near the heel portion 3*d* to a position in the toe portion 3*c* near the top portion 3*a*. In the depressed part 12*a* and depressed part 12*b*, the amount W is set in a range of from about 2 mm to about 7 mm.

Comparison Tests

Iron-type golf club heads for #5 iron (loft angle 26 degrees) having the same basic structure (two piece structure) shown in FIGS. 1A and 2 except for the specifications of the face portion were made and tested for the rebound performance and durability. The face plate was made of titanium alloy Ti-6Al-4V, and the head main body was made of stainless steel SUS630.

Rebound Performance Test

According to the "Procedure for Measuring the velocity Ratio of a club Head for Conformance to Rule 4-1e, Appendix II, Revision 2 (Feb. 8, 1999), United States Golf Association.", the restitution coefficient "e" was obtained using the following equation:

$$Vo/Vi=(eM-m)/(M+m)$$

wherein

Vo: ball rebound velocity

Vi: ball incoming velocity

M: the mass of the club head m: the mass of the ball.

As specified therein, the golf balls used were "Titleist, PINNACLE GOLD" and the radius of the target circle centered on the sweet spot was 5 mm. The distance between the club face and the launching device was 55 inches, and the incoming ball velocity was 160±0.5 feet/sec.

Durability Test

The golf club heads were attached to identical shafts to make #5 iron. The club was attached to a swing robot and hit golf balls ("MAXFRI HI-BRID" Sumitomo Rubber Industries, Ltd.) 3000 times at a head speed of 43 m/s. Then, the club face was checked. If a dent was found the depth was measured. From a practical standpoint of the durability, a dent of less than 0.1 mm is acceptable.

The test results are shown in Table 1.

TABLE 1

| Club head | Ref. 1 | Ref. 2 | Ref. 3 | Ref. 4 | Ex. 1 | Ex. 2 | Ex. 3 | Ex. 4 | Ex. 5 | Ref. 5 | Ex. 6 | Ex. 7 |
|---|---|---|---|---|---|---|---|---|---|---|---|---|
| Club face | | | | | | | | | | | | |
| Area (sq. mm) | 2950 | 2950 | 2950 | 2950 | 2950 | 2950 | 2950 | 2950 | 2950 | 3010 | 2950 | 2990 |
| Sweet spot height (mm) | 20.5 | 20.5 | 20.6 | 20.4 | 20.5 | 20.4 | 20.6 | 20.5 | 20.4 | 21.2 | 20.5 | 21.5 |
| Gravity center distance (mm) | 40.2 | 40.2 | 40.0 | 40.8 | 40.1 | 40.4 | 40.3 | 41.0 | 42.0 | 38.1 | 40.2 | 37.2 |
| Thin part | | | | | | | | | | | | |
| Thickness t (mm) | 3.2 | 3.2 | 2.8 | 3.2 | 2.8 | 2.8 | 2.8 | 2.8 | 2.8 | 2.8 | 2.8 | 2.8 |
| Area (sq. mm) | 1480 | 1520 | 1520 | 1580 | 1580 | 1630 | 1630 | 1810 | 1905 | 1490 | 1505 | 1770 |
| Distance L1 (mm) | 28.2 | 29.5 | 29.5 | 30.3 | 30.3 | 31.5 | 33.2 | 35.3 | 38.2 | 28.2 | 30.3 | 39.5 |
| Distance L2 (mm) | 64 | 67 | 67 | 68 | 68 | 69 | 71 | 71 | 72 | 67 | 65 | 59 |
| Ratio L2/L1 | 2.30 | 2.27 | 2.27 | 2.24 | 2.24 | 2.19 | 2.14 | 2.01 | 1.88 | 2.38 | 2.30 | 1.49 |
| Test result | | | | | | | | | | | | |
| Restitution coefficient | 0.755 | 0.757 | 0.760 | 0.759 | 0.776 | 0.778 | 0.783 | 0.787 | 0.790 | 0.760 | 0.785 | 0.789 |
| Durability *1 | NP | NP | NP | NP | NP | NP | NP | NP | slight dent | NP | NP | NP |

*1 NP: nothing peculiar

From the test results, it was confirmed that when the minimum distance L1 of the thin part exceeds 30 mm, the rebound performance can be greatly improved without sacrificing the durability.

The present invention can be applied to various iron-type golf club heads, but it is more suitably applied to club heads whose loft angle is 16 to 38 degrees, especially 17 to 34 degrees (which may be long iron through middle iron) because the improvement in the rebound performance is more effectual on the increase in carry in case of such heads.

Although the above-explained embodiment has the two-piece structure of the main body 3 and face plate 2, the club head may be formed of a one-piece structure of a single metal material. In the above embodiment, the hollow (hole) formed behind the face portion 2 is opened. In other words, the back surface of the face plate 2 is exposed. But it is also possible to close the hollow to fully cover the back surface. Further, it is possible to partially cover the back surface. Furthermore, it may be possible to fill the hollow with a soft or elastic material.

The invention claimed is:

1. An iron-type golf club head having sole, heel and toe sides comprising:

a face portion having a front surface which defines a club face for hitting a ball, the face portion being provided with a thin part which is defined as having a thickness of not more than 3 mm, wherein the thin part defines at least a part of said club face including a sweet spot, and an annular part surrounding the face portion and supporting a back surface circumferential portion of the face portion, the annular part having a thickness greater than the thin part and having a first depressed portion beneath the sweet spot on the sole side of the golf club head, and the annular part has a second depressed portion on the toe side of the golf club head; and wherein the distance across the thin part measured in every direction passing through the sweet spot becomes a minimum L1 in a certain direction, and the minimum L1 is not less than 30 mm.

2. An iron-type golf club head according to claim 1, wherein the minimum distance L1 is in a range of from 30 to 45 mm.

3. An iron-type golf club head according to claim 1, wherein the thickness of the thin part is in a range of from 2.0 to 2.8 mm.

4. An iron-type golf club head according to claim 1, wherein the minimum distance L1 is in a range of from 30 to 45 mm, and the thickness of the thin part is in a range of from 2.0 to 2.8 mm.

5. An iron-type golf club head according to claim 1, 2, 3 or 4, wherein the distance across the thin part measured in a direction at a right angle to said certain direction passing through the sweet spot is not less than 65 mm.

6. An iron-type golf club head according to claim 1, 2, 3 or 4, wherein the distance across the thin part measured in a direction at a right angle to said certain direction passing through the sweet spot is not less than 65 mm and in a range of from 1.44 to 2.30 times the minimum distance L1.

7. An iron-type golf club head according to claim 1, wherein the depressed portion extends outwardly of the annular part from an inner circumferential portion in a range of from 2 mm to 7 mm.

8. An iron-type golf club head according to claim 1, wherein the annular part has a third depressed portion circumferentially extending to connect the first and second depressed portions, wherein the third depressed portion extends outwardly from an inner circumferential portion of the annular part a distance less than the corresponding distance of the first and second depressed portions.

9. An iron-type golf club head according to claim 1, wherein the height of the sweet spot is in a range of from 18 to 22 mm.

10. An iron-type golf club head according to claim 1, wherein the center of gravity of the head is at a distance in a range of from 35 to 42 mm from a club shaft center line.

11. An iron-type golf club head according to claim 1, wherein the face portion has a Young's modulus in a range of from 70 to 200 GPa.

12. An iron-type golf club head according to claim 1, which is composed of a face plate forming the face portion and a main body to which the face plate is attached, wherein the face plate has a Young's modulus in a range of from 70 to 200 GPa, and the main body has a specific gravity more than that of the face plate.

* * * * *